United States Patent [19]

Belli et al.

[11] Patent Number: 4,589,323

[45] Date of Patent: May 20, 1986

[54] DRUM MUFFLER

[75] Inventors: Remo Belli, Sherman Oaks; Donald R. Hartry, La Canada, both of Calif.

[73] Assignee: Remo, Inc., North Hollywood, Calif.

[21] Appl. No.: 489,836

[22] Filed: Apr. 29, 1983

[51] Int. Cl.[4] ..... G10D 13/02

[52] U.S. Cl. ..... 84/411 R; 84/411 M; 84/411 P

[58] Field of Search ..... 84/411 R, 411 A, 411 M, 84/411 P, 415, 416, 417

[56] References Cited

U.S. PATENT DOCUMENTS

| | | | |
|---|---|---|---|
| 570,693 | 11/1896 | Bemis . | |
| 609,068 | 8/1898 | Zeidelr . | |
| 614,694 | 11/1898 | Boulanger | 84/411 |
| 2,285,269 | 6/1942 | Grolimund | 84/415 |
| 2,499,616 | 3/1950 | Walberg | 84/411 |
| 3,105,406 | 10/1963 | Ippolito | 84/411 P |
| 3,250,169 | 5/1966 | Stone, Jr. et al. | 84/411 |
| 3,264,927 | 8/1966 | Fischetti | 84/411 |
| 3,433,115 | 3/1969 | Kjelstrom | 84/411 |
| 3,435,723 | 4/1969 | Corder | 84/411 |
| 3,453,924 | 7/1969 | Glick et al. | 84/411 |
| 4,154,137 | 5/1979 | Kobayashi | 84/411 |
| 4,226,156 | 10/1980 | Hyakutake | 84/1.14 |
| 4,244,266 | 1/1981 | Hardy | 84/411 M |
| 4,246,825 | 1/1981 | Hodas | 84/415 |
| 4,325,280 | 4/1982 | Hardy | 84/411 |
| 4,325,281 | 4/1982 | Hardy | 84/411 |
| 4,338,850 | 7/1982 | Payson | 84/411 M |

*Primary Examiner*—L. T. Hix
*Assistant Examiner*—Douglas S. Lee
*Attorney, Agent, or Firm*—Lyon & Lyon

[57] ABSTRACT

This invention relates to a sound altering device for a drum comprising a shell, head fastening means and a head with a playing surface and a rim. The sound altering means comprising a circular base with at least one aperture, and a rim mounting means integral with circular base, the rim mounting means being adapted to fit over the edge of the shell so that the circular base is suspended underneath the playing surface, the rim mounting means being adapted to be held between the edge of the shell and the rim.

19 Claims, 3 Drawing Figures

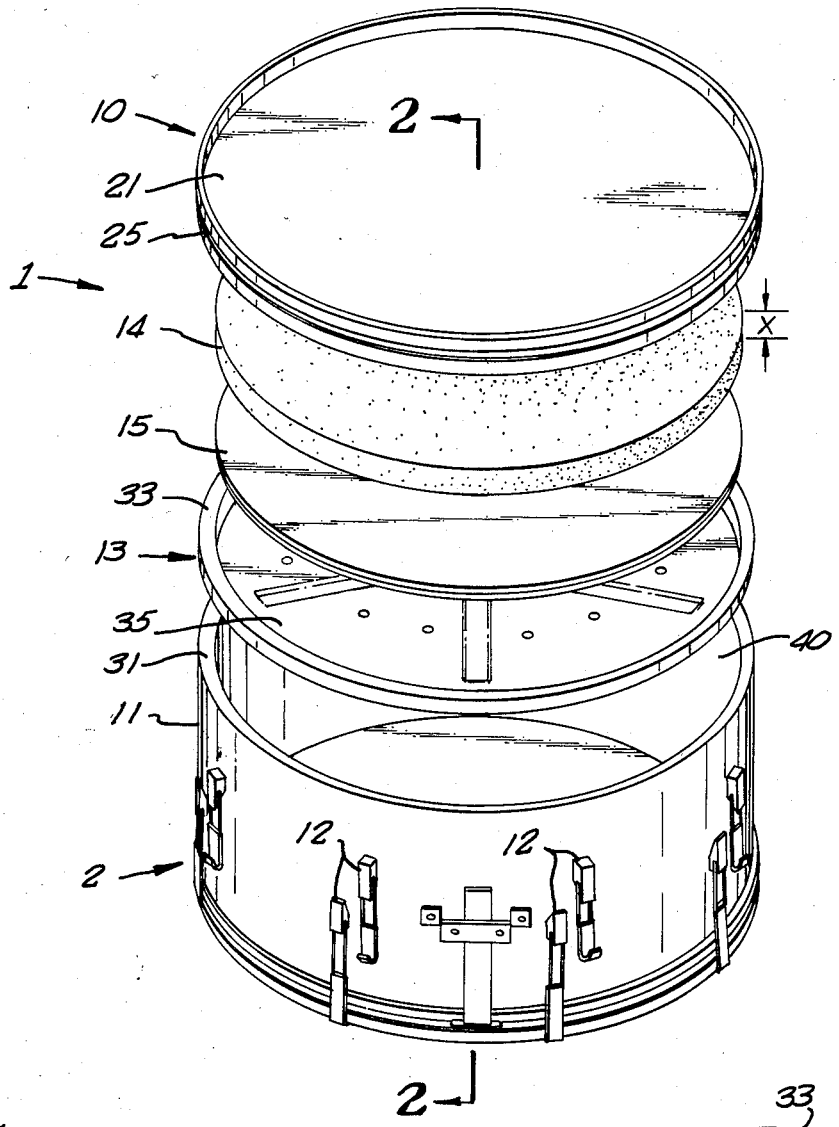
FIG. 1.
FIG. 2.
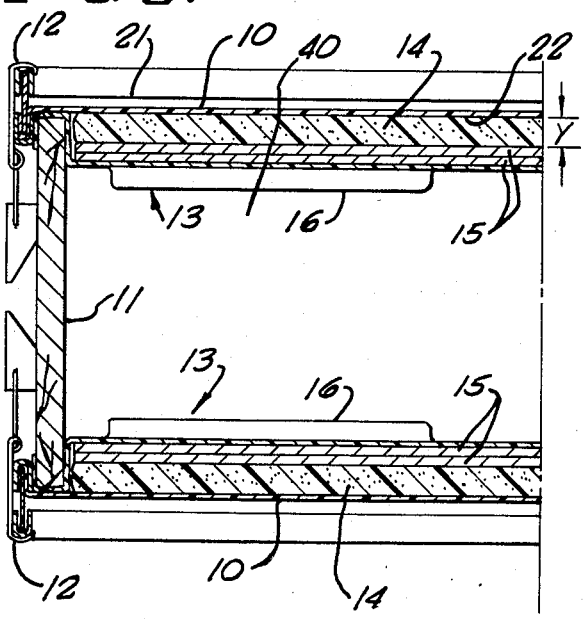
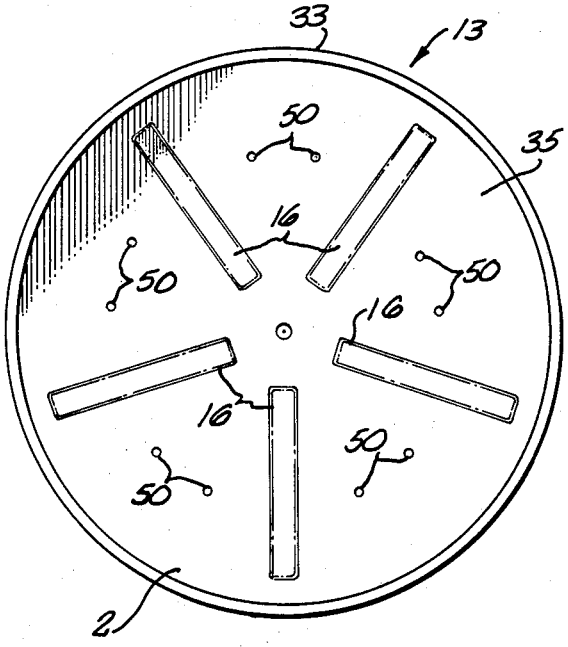
FIG. 3.

DRUM MUFFLER

BACKGROUND OF THE INVENTION

1. Field of the Invention

This invention relates to a drum sound altering device which may be removably mounted underneath the head of a drum.

2. Description of the Prior Art

When drummers practice, they either practice with their actual drums or they use a device called a practice pad. If they practice with their actual drum, the result obviously is rather noisy, although the drummer does have the true feel of the actual drum. The practice pad is similar to a drum head, although it has no drum shell, and it has sound absorbing material to reduce the sound of drumsticks hitting the practice pad. However, when a practice pad is used, a drummer does not experience the same relationship between the drumsticks and the drum, and the practice pad is a bulky item that must be carried with the drummer.

As an alternative to a practice pad, some drummers in the past have placed a sheet of rubber or similar such material on top of the drum head. Such a sheet of material does provide a sound absorbing effect; however, the true feel of the drum is once again lost to the drummer.

As another alternative, some drummers have removed the drum head and then filled the drum shell with towels, sponges, a pillow, or other similar such sound absorbing material. By utilizing this approach, the drummer still achieves the same relationship between the drumsticks and the drum; however, the drummer also has to carry a load of sponges, towels, etc. which is inconvenient if the drummer must travel. In addition, the drummer must always fill the shell with such items which often produce a non-uniform muffling effect or a muffling effect which varies from session to session depending upon the placement of such items within the shell.

SUMMARY OF THE INVENTION

The present invention utilizes an insertable plastic support means to hold a layer of resilient foam against the underside of a drum head. The foam reduces the sound of the drum while reducing drum overtones. A rim is formed in the plastic support means which is placed over the shell to support the foam sound absorbing material. When the drum head rim is mounted on top of the support means and attached to the shell, the drum fastening means will secure the muffling support means and the drum head to the shell. An optional layer of stiff material such as cardboard may be placed between the foam and the plastic support means so that the foam will be compressed and biased against the drum head.

The present invention also provides a means for harmonically altering the overtones of a drum without reducing the sound. By providing the support means with an alterable pattern of holes, the muffling support means will reduce drum overtones when the foam sound absorbing material is removed.

Thus, it is a primary obejct of the present invention to provide an arrangement for muffling the sound of a drum.

It is another object of the present invention to provide an inexpensive, compact drum muffler which may be quickly and simply installed in or removed from a drum.

It is another object of the present invention to provide a drum muffler which does not affect the true feel of the actual drum head.

It is another object of the present invention to reduce or eliminate drum overtones.

It is a further object of the present invention to provide an arrangement which can impart a variable degree of sound muffling while allowing tonal variations on a drum to be altered.

These and even further objects will become apparent in connection with the drawings and detailed description of the preferred embodiment which are described below.

BRIEF DESCRIPTION OF THE DRAWINGS

FIG. 1 is an exploded view of a drum with a muffler in accordance with the present invention mounted under the top drum head;

FIG. 2 is a cross-section taken along line 1—1 of FIG. 1 in an unexploded state with a muffler mounted under both the top and bottom drum heads;

FIG. 3 is a plan view of the muffler support means with holes to harmonically modify drum overtones.

DETAILED DESCRIPTION OF THE INVENTION

As is shown in FIGS. 1 and 2, the muffler, generally designated as 1, may be used in a drum, generally designated as 2, which includes a drum head 10, shell 11 and fastening members 12. The drum head 10 has a playing surface 21 which is affixed to a rim 25 which, in turn, is mounted upon shell 11 by fastening members 12, all as more fully described in U.S. patent application Ser. No. 416,069 filed Sept. 8, 1982 and assigned to the assignee of the present application, the disclosure of which is incorporated herein by reference.

As shown in FIGS. 1 and 2, the muffler 1 comprises a plastic support, generally designated as 13, a sheet of plastic foam material 14, and a cardboard backing 15. The plastic support 13 is shown with integral stiffners or supports 16 which may comprise an additional thickness of plastic material. The plastic support 13 has a rim 33 which fits over an edge 31 of the shell 11 to suspend an inner circular base 35 within the interior 40 of the shell. While the present embodiment contemplates a circular rim 33, a continuous rim could be replaced by other supporting means such as clips or similar such devices. The circular cardboard backing 15 is placed upon the base 35 to provide a relatively rigid support for the foam 14 which is then placed on top of the cardboard backing 15 and is biased against the underside 22 of playing surface 21. However, the cardboard backing 15 is optional and may be omitted without departing from the inventive concept described herein.

The extent to which the foam 14 is biased against underside 22 will depend upon the thickness x of the foam in an uncompressed state and the distance y between the cardboard backing 15 and the underside 22. By altering the thickness x of the foam or the distance y, and thereby the compression of the foam, the extent of muffling provided by the muffler 1 may be varied. In a similar manner, the degree of muffling may be varied by altering the sound absorbing characteristics of the foam 14. The extent or uniformity of muffling can also be altered by variations in the density of the foam or the thickness of portions of the foam. As an extreme example of the latter, the foam may be shaped as a cone. Additionally, it has been found that variations in the geometric design of the foam 14 can allow tonal variations to be changed on the drum. Thus, the foam can be shaped in the form of an annulus to reduce overtones.

When the foam 14 and cardboard backing 15 are removed from the muffler 1, the plastic support 13 will act as a sound changer harmonically modifying drum overtones. The changes are produced by apertures 50 which are provided in the circular base 35. While a plurality of holes are depicted in FIG. 3, it has been found that a single hole in the center of circular base 35 will reduce the overtures of a drum. Thus, the placing of a hole or a plurality of holes in the circular base may be designed so as to achieve varying degrees of sound modification.

To achieve variable sound modification, inserts with holes may be placed on top of circular base 35 in a manner similar to the placement of cardboard backing 15. The partial alignment of the holes in such an insert or inserts with the holes 50 will produce different sound modifications.

While the present invention has been described as applying to only one drum head, it should be understood that the quietest results are achieved when a muffler in accordance with the present invention is utilized on the underside of both drum heads, as depicted in FIG. 2. Alternatively, a drummer can muffle one side of a drum to allow practice on one side while still playing the other side of the drum in the usual way.

While the preferred embodiment of the present invention has been shown and described, it will be apparent to those skilled in the art that many more modifications are possible without departing from the inventor's concept herein described. This invention, therefore, is to be limited only by the lawful scope of the claims which follow.

What is claimed is:

1. A sound altering means for a drum comprising a shell, head fastening means and a head with a playing surface and a rim, the sound altering means comprising:

a circular base with at least one aperture; and a rim mounting means integral with the circular base, the rim mounting means being adapted to fit over the edge of the shell so that the circular base is suspended underneath the playing surface, the rim mounting means being adapted to be held between the edge of the shell and the rim.

2. A sound altering means as recited in claim 1 further comprising muffling means held between the underneath side of the playing surface and the circular base.

3. A sound altering means as recited in claim 2 wherein the muffling means comprises a rigid member and a sound absorbing material mounted within the interior of the shell, the rigid member being affixed to the fastening means, the sound absorbing material comprising a foam biased against the underside of the playing surface and at least partially compressed between the rigid member and underside of the playing surface.

4. A sound altering means as recited in claim 3 wherein the sound absorbing material is of a non-uniform thickness.

5. A sound altering means as recited in claim 3 wherein the sound absorbing material is of a non-uniform density.

6. A sound altering means as recited in claim 3 wherein the sound absorbing material is in the shape of a circular disc substantially the same diameter as the underside of the playing surface and of uniform thickness.

7. A sound altering means as recited in claim 3 wherein the sound absorbing material is in a shape other than that of a circular disc.

8. A sound altering means as recited in claim 1 wherein the sound altering means is capable of harmonically altering the overtones of the drum without reducing the sound.

9. A sound altering means as recited in claim 1 wherein the circular base has a plurality of apertures.

10. A sound altering means as recited in claim 1 further comprising an insert with at least one aperture.

11. A sound altering means for a drum comprising a shell, head fastening means and a head with a playing surface and a rim, the sound altering means comprising affixation means comprised of a circular support and a rim mounting means integral with the circular support, the rim mounting means being adaptable to fit over and grip an edge of the shell so that the circular support is suspended underneath the head, the rim mounting means being adapted to be held between the edge of the shell and the rim said circular support being rigid and having at least one aperture which at least partially reduces the overtones of the drum.

12. A sound altering means as recited in claim 11 further comprising an insert with at least one aperture suspended by the circular support underneath the head.

13. A sound altering means for a drum comprising a shell, head fastening means and a head with a playing surface and a rim, the sound altering means comprising:

affixation means removably connected to the shell comprised of a circular support and a rim mounting means integral with the circular support, the rim mounting means being adaptable to fit over and grip an edge of the shell so that the circular support is suspended underneath the head, the rim mounting means being adapted to be held between the edge of the shell and the rim;

said circular support being rigid and, having at least one aperture which at least partially reduces the overtones of the drum.

14. A drum, comprising a circular playing surface, a rim, the outer circumference of the playing surface being affixed to the rim, a shell, fastening means for removably mounting the rim to the shell, and sound modifying means removably mounted to the shell beneath the rim wherein the sound modifying means comprises a circular base with at least one aperture and rim mounting means integral with the circular base, the rim mounting means being adapted to fit over the edge of the shell so that the circular base is suspended underneath the playing surface, the rim mounting means being held between the edge of the shell and the rim.

15. A drum as recited in claim 14 wherein said sound modifying mean further comprises muffling means held between the underneath side of the playing surface and the circular base.

16. A sound altering means as recited in claim 15 wherein the muffling means is comprised of a sound absorbing material of a non-uniform thickness.

17. A drum as recited in claim 15 wherein the muffling means is comprised of a sound absorbing material of a non-uniform density.

18. A drum as recited in claim 15 wherein the muffling means is comprised of a sound absorbing material in the shape of a circular disc substantially the same diameter as the underside of the playing surface and of uniform thickness.

19. A drum as recited in claim 15 wherein the muffling means is comprised of a sound absorbing material in a shape other than a circle.

* * * * *